US005090384A

United States Patent [19]

Ahlborn et al.

[11] Patent Number: 5,090,384

[45] Date of Patent: * Feb. 25, 1992

[54] ELECTRONIC CONTROL DEVICE FOR MODULATING FUEL QUANTITIES IN AN INTERNAL COMBUSTION ENGINE

[75] Inventors: Frank Ahlborn, Milan, Italy; Volker Schäfer, Steinheimlmurr; Sieber Albrecht, Ludwigsburg, both of Fed. Rep. of Germany

[73] Assignee: Robert Bosch GmbH, Stuttgart, Fed. Rep. of Germany

[ * ] Notice: The portion of the term of this patent subsequent to Feb. 19, 2008 has been disclaimed.

[21] Appl. No.: 585,112

[22] PCT Filed: Mar. 25, 1988

[86] PCT No.: PCT/EP88/00250

§ 371 Date: Sep. 25, 1990

§ 102(e) Date: Sep. 25, 1990

[87] PCT Pub. No.: WO89/09332

PCT Pub. Date: Oct. 5, 1989

[51] Int. Cl.[5] ..... F02D 41/14; F02D 41/04

[52] U.S. Cl. ..... 123/436; 123/357

[58] Field of Search ..... 123/419, 436, 357; 364/431.08

[56] References Cited

U.S. PATENT DOCUMENTS

| | | | |
|---|---|---|---|
| 4,271,798 | 6/1981 | Seitz et al. | 123/419 |
| 4,357,662 | 11/1982 | Schira et al. | 123/436 |
| 4,476,833 | 10/1984 | Johnson et al. | 123/436 |
| 4,478,186 | 10/1984 | Bauer et al. | 123/436 |
| 4,495,920 | 1/1985 | Matsumura et al. | 123/436 |
| 4,509,484 | 4/1985 | Gertiser | 123/436 |
| 4,635,601 | 1/1987 | Genelius | 123/436 |
| 4,656,986 | 4/1987 | Kull et al. | 123/419 |
| 4,799,469 | 1/1989 | Nagano et al. | 123/419 |
| 4,811,224 | 3/1989 | Kuerschner et al. | 123/419 |
| 4,862,853 | 9/1989 | Tsukamoto et al. | 123/419 |
| 4,883,038 | 11/1989 | Nakaniwa | 123/436 |
| 4,936,277 | 6/1990 | Deutsch et al. | 123/436 |
| 4,993,389 | 2/1991 | Ahlborn et al. | 123/436 |

FOREIGN PATENT DOCUMENTS 2372320 6/1978 France .

*Primary Examiner*—E. Rollins Cross
*Assistant Examiner*—Thomas N. Moulis
*Attorney, Agent, or Firm*—Walter Ottesen

[57] ABSTRACT

A device for electronically controlling adjusting devices in an internal combustion engine in which the adjusting devices can be controlled, by comparing differentiated engine speed signals with predetermined threshold values in such a way that shuddering oscillations of the internal combustion engine are counteracted. The engine speed variable (n) is derived by means of a sensor (10) which provides a plurality of pulses per revolution of the engine crankshaft or camshaft. A first divider (14) divides the pulses from the sensor (10) by a fixed ratio. The output of the divider (14) is further divided in a divider arrangement which provides different divider ratios in dependence upon engine speed, the divider ratios being chosen so that measurement at engine speed is made over a complete combustion period of the engine, or a multiple thereof.

6 Claims, 2 Drawing Sheets

ELECTRONIC CONTROL DEVICE FOR MODULATING FUEL QUANTITIES IN AN INTERNAL COMBUSTION ENGINE

FIELD OF THE INVENTION

The present invention is concerned with electronic control devices for modulating fuel quantities in internal combustion engines wherein an electronically controllable adjusting device supplies fuel to the engine cylinders.

BACKGROUND OF THE INVENTION

In motor vehicles, the interaction of the internal combustion engine, elastic suspension and oscillating masses often stimulates shuddering oscillations which interfere with the behaviour of the motor vehicle. Such oscillations can also be brought about by acceleration or deceleration (overrun) operation.

Published German patent application DE 29 06 782 describes a device for damping shuddering oscillations in an internal combustion engine, whereby it is assumed that clearly measurable fluctuations in speed are associated with the shuddering oscillations. These measured fluctuations in speed are derived from the differential of an engine speed signal. The differentiated speed signal is itself then fed to the fuel quantity control means in order to counteract the shuddering oscillations.

The latter known device, which intervenes directly in the fuel quantity control, is however not suitable for all operating conditions of a motor vehicle or of an oscillated internal combustion engine, because the connection of the differentiated speed signal to the fuel quantity control means can also lead to instabilities in the control loop.

U.S. patent application Ser. No. 353,669, filed May 8,1989, now U.S. Pat. No. 4,993,389 describes a device for damping shuddering oscillations in internal combustion engines, wherein such shuddering oscillations are effectively damped, particularly during acceleration and in overrun operation, but which does not intervene directly in the fuel quantity control loop. In this latter device, the input variable to the device is the engine speed (n), the derivative (n) of the speed-dependent (n) being compared with predetermined threshold values between which the fuel quantity is arranged to be modulated in such a way that shuddering oscillations of the internal combustion engine are counteracted. The output of the device is therefore a switching signal which is used for control of its solenoid or solenoids of the fuel injection valves of the engine.

As mentioned above, the input variable to the device is the engine speed (n) and it is required that this input variable should be as free as possible from interference in order to avoid false interpretation by subsequent signal handling components of the device.

In the system disclosed in the above-mentioned U.S. patent application Ser. No. 353,669, a speed sensor is associated with the camshaft or crankshaft of the engine and provides 144 pulses per revolution of the associated shaft A divider (÷16) reduces the number of pulses per revolution to 9. The latter pulses are processed in a circuit which deduces the rotational speed (n) of the shaft from the pulses received thereby. The resulting speed signal is then differentiated to provide the first derivative (n).

Such a device has the disadvantage that in order to remove interference it is necessary to provide a low-pass (PT1) filter between the rotational speed sensor and the differentiator.

SUMMARY OF THE INVENTION

The control device of the invention overcomes the above disadvantage by obviating the necessity for the inclusion of the low-pass PTl filter.

A problem is that the engine speed is not constant during a combustion period and the speed sensor signal therefore varies accordingly. The influence of the problem is minimised in accordance with the present invention in that the pulses provided by the sensor are divided in a divider arrangement such that a measurement of engine speed is made over a complete combustion period of the engine, or a multiple thereof.

According to another feature of the invention, the division ratio can be made to be speed-dependent so as to enable measurements to be made over a multiple of a complete combustion period at higher engine speeds.

In an advantageous embodiment, the divider arrangement includes a first fixed divider, a second divider to which the output of the first divider is fed when the engine speed is above a predetermined engine speed and a third divider to which the output of the first divider is fed when the engine speed is below said predetermined engine speed.

In a typical embodiment, the predetermined engine speed is approximately 2000 r.p.m.

BRIEF DESCRIPTION OF THE DRAWINGS

The invention is described further hereinafter, by way of example only, with reference to the accompanying drawings in which.

DESCRIPTION OF THE PREFERRED EMBODIMENTS OF THE INVENTION

Figure 1:
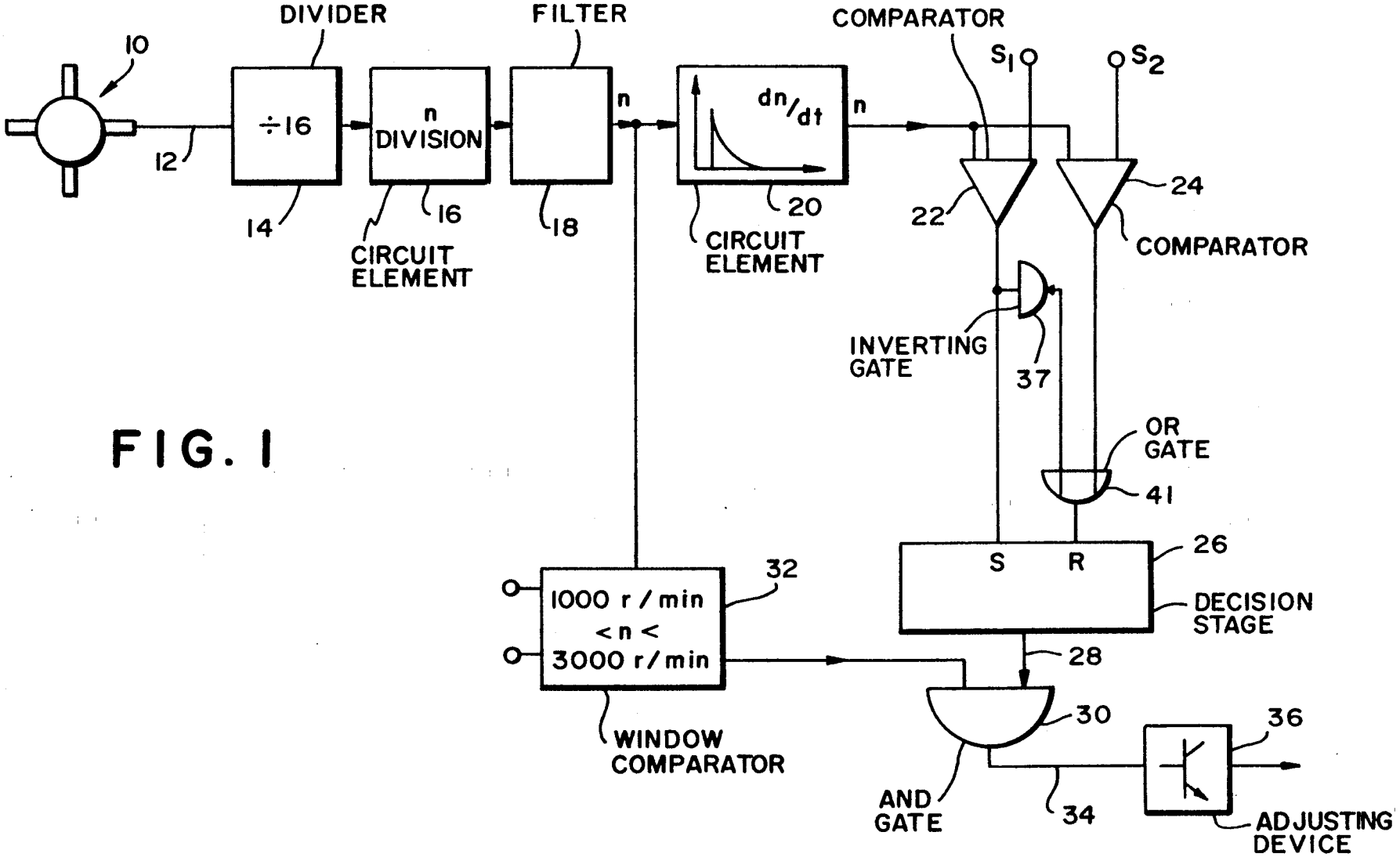
FIG. 1 is a simplified block circuit diagram of one embodiment of an electronic control device for damping shuddering vibrations and to which the present invention is applicable.

Referring first to the known circuit of FIG. 1, an engine speed detector 10 operates in conjunction with the engine crankshaft or camshaft to produce a series of engine-speed dependent pulses (e.g. 144 per revolution) on line 12. This pulsed output from the detector 10 is fed to a divider 14, which may have a variable division ratio, but which in this case divides by 16 to produce 9 pulses per revolution. The engine speed n is determined in a circuit element 16 from the pulses detected in the detector 10 and divided in divider 14. The speed signal which has been determined in this way is filtered in a filter 18 in order to reduce interference.

The filtered speed signal is differentiated in circuit element 20 to provide the first derivative of speed (n) and is then fed to a pair of comparators 22,24 where it is compared with two predetermined threshold values $S_1$,$S_2$. The arrangement is such that if n exceeds the first threshold $S_1$, a logical 1 is applied to the output of comparator 22 to provide a triggering input to a decision stage 26 for initiating a signal on line 28 to one input of an AND gate 30.

The speed signal from the filter 18 is also fed to a window comparator 32 for limiting the speed range in which fuel quantity correction is to take place. This window comparator 32 causes a signal to be passed to a second input of the AND gate 30 when the speed signal from the filter 18 lies between upper and lower predetermined values, in this case between an upper limit of 3000 r.p.m. and a lower limit of 1000 r.p.m. Only when the window comparator 32 supplies an output signal to the AND gate 30 does the AND gate 30 enable the decision stage 26 to provide an output on line 34 to an adjusting device 36 which controls the supply of fuel to the engine cylinders.

Thus, if n lies between 1000 and 2000 r.p.m. when the value n exceeds threshold $S_1$, then a signal is provided on line 34 to actuate the adjusting device 36 for the control of shuddering oscillations and the flip-flop 26 is arranged to be set If the value of n eventually exceeds threshold $S_2$, the flip-flop 26 is reset which removes the output signal on lines 28 and 34 so that the adjusting device 36 is no longer controlled. Should the value of n exceed $S_1$, but not $S_2$, the control of the adjusting device ceases when the value of n drops again below threshold $S_1$. Therefore the output signal of comparator 22 is inverted by gate 37 and then passed to an OR gate 41 to reset the flip-flop 26 in this case For a fuller explanation of the operation of the adjusting device 36 in controlling shuddering oscillations, reference is hereby directed to the above-mentioned U.S. patent application Ser. No. 353,669, now U.S. Pat. No. 4,993,389 incorporated by reference therefor.

Figure 2:
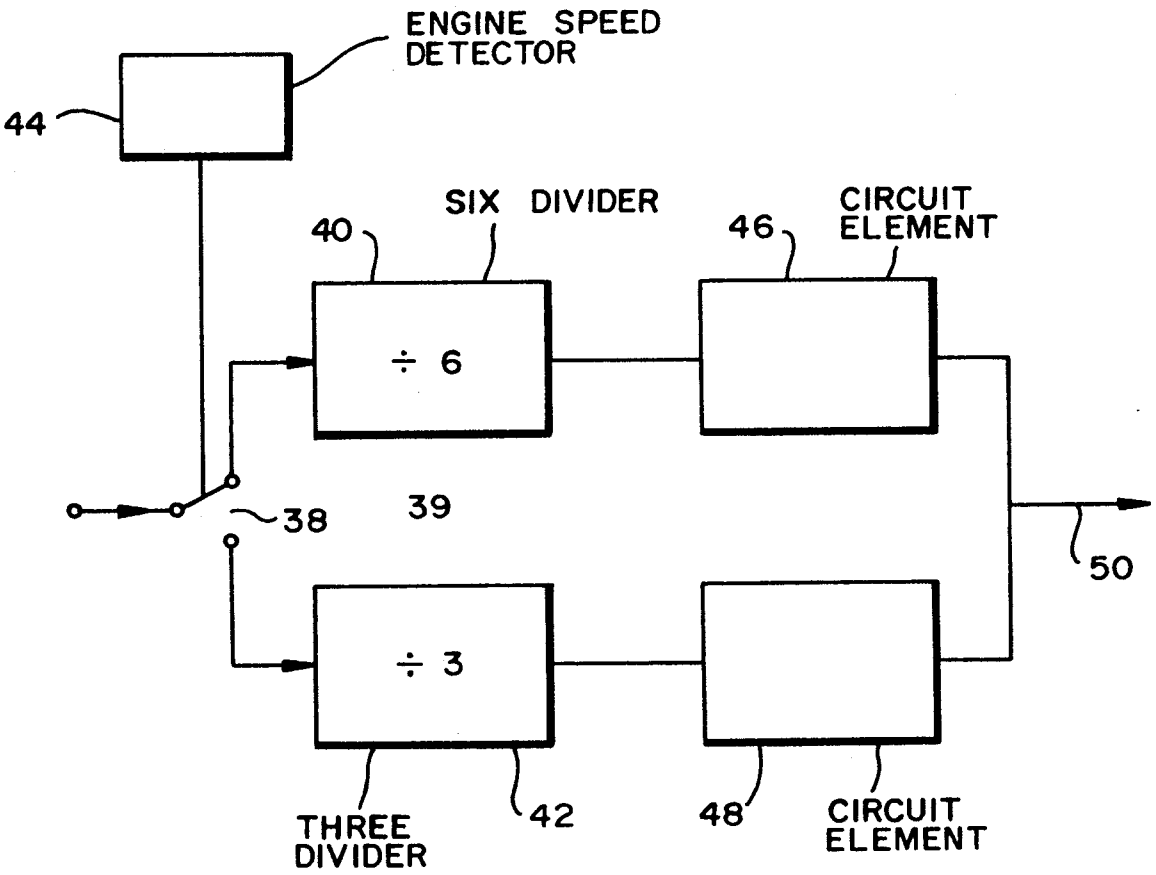
FIG. 2 is a simplified block circuit diagram of a modification to the circuit of FIG. 1, having a speed-dependent divider circuit in accordance with the present invention.

Referring now to FIG. 2 of the accompanying drawings, in the present device the filter 18 of FIG. 1 is omitted altogether and the pulses from the divider 14 are fed to a speed-dependent divider arrangement 39 as shown in FIG. 2. The pulses from the divider 14 are fed by a change-over switch 38 either to a divide by six divider 40 or to a divide by three divider 42. The position of the switch 38 is arranged to be engine speed-dependent in that in an upper engine speed range (for example above 2000 r.p.m.), determined by an engine speed detector 44, the switch 38 connects the input pulses to the divider 40 whereas in a lower engine speed range (for example below 2000 r.p.m.) the switch 38 connects the input pulses to the divider 42. In the case of the ÷3 divider 42, the engine speed calculated in a subsequent block circuit element 46 is determined on the basis of 3 pulses per revolution, i.e. a measurement is made every 120°, whereas in the case of the ÷6 divider 40, the engine speed calculated in a subsequent circuit element 48 is determined on the basis of a measurement made every 240°. The resulting speed dependent signals from the elements 46,48 are supplied by a common line 50 to the differentiating element 20 (FIG. 1).

Thus, in the case of for example 6 cylinder engine, at low speeds below 2000 r.p.m engine speed measurements are made every 120° by way of the ÷16 divider 14 and ÷3 divider 42 whereas at speed above 2000 r.p.m., engine speed measurements are made every 240° by way of the ÷16 divider 14 and ÷6 divider 40, i e. below 2000 r.p.m., engine speed is measured over a complete combustion period, whereas above 2000 r.p.m. engine speed is measured over two complete combustion periods.

The advantage of this method of determining the engine speed is the resulting freedom from interference of the magnitudes Δn which are derived from the speed signal. Furthermore no filter is required. This simplification of the speed determination algorithm reduces the load on the computer which is usually used in a practical embodiment to implement the control device.

We claim:

1. An electronic control arrangement for modulating fuel quantities in an internal combustion engine, the arrangement comprising:

an adjusting device for controlling the supply of fuel to the engine cylinders;

speed detector means for detecting the speed of the engine and providing a speed signal (n) in the form of a plurality of pulses per revolution of the engine crankshaft or camshaft;

divider means for dividing said pulses so as to provide a measurement of engine speed over a complete combustion period of the engine or multiple thereof with said divider means having a division ratio dependent upon engine speed;

differentiating means for forming a first derivation (n) of said speed signal (n); and, comparator means for comparing said first derivative (n) with a threshold value above which the fuel quantity is modulated by said adjusting device in such a way that shuddering oscillations of the engine are counteracted.

2. The electronic control device of claim 1, wherein said divider means includes a first fixed divider; a second divider to which the output of said first fixed divider is fed when the engine speed is above a predetermined engine speed; and, a third divider to which the output of said first fixed divider is fed when the engine speed is below said predetermined engine speed.

3. The electronic control device of claim 2, wherein said second divider operates to divide by 6 and said third divider operates to divide by 3.

4. The electronic control device of claim 2, wherein said predetermined engine speed is approximately 2000 rpm.

5. The electronic control device of claim 2, wherein said first fixed divider operates to divide by 16.

6. The electronic control device of claim 1, wherein said sensor means operates to provide 144 pulses per revolution of the crankshaft or camshaft.

* * * * *

UNITED STATES PATENT AND TRADEMARK OFFICE

CERTIFICATE OF CORRECTION

PATENT NO. : 5,090,384

DATED : February 25, 1992

INVENTOR(S) : Frank Ahlborn, Volker Schäfer and Albrecht Sieber

It is certified that error appears in the above-identified patent and that said Letters Patent is hereby corrected as shown below:

On the title page, under "Inventors", reference numeral [75], lines 2 and 3: delete "Sieber Albrecht" and substitute -- Albrecht Sieber -- therefor.

On the title page, under "References cited, U.S. Patent Documents", reference numeral [56], line 7: delete "Genelius" and substitute -- Cornelius -- therefor.

In column 1, line 44: delete "(n)" and substitute -- (ṅ) -- therefor.

In column 1, line 61: between "shaft" and "A", insert -- . --.

In column 1, line 66: delete "(n)" and substitute -- (ṅ) -- therefor.

In column 2, line 59: delete "(n)" and substitute -- (ṅ) -- therefor.

In column 2, line 62: delete "n" and substitute -- ṅ -- therefor.

UNITED STATES PATENT AND TRADEMARK OFFICE

CERTIFICATE OF CORRECTION

PATENT NO. : 5,090,384

DATED : February 25, 1992

INVENTOR(S) : Frank Ahlborn, Volker Schäfer and Albrecht Sieber

It is certified that error appears in the above-identified patent and that said Letters Patent is hereby corrected as shown below:

In column 3, line 13: delete "n" and substitute -- of ṅ -- therefor.

In column 3, line 16: between "set" and "If", insert -- . --.

In column 3, line 16: delete "n" and substitute -- ṅ -- therefor.

In column 3, line 19: delete "n" and substitute -- ṅ -- therefor.

In column 3, line 21: delete "n" and substitute -- ṅ -- therefor.

In column 3, line 24: between "case" and "For", insert -- . --.

In column 3, line 29: after "reference" delete "therefor".

In column 4, line 3: delete "ie." and substitute -- i.e. -- therefor.

UNITED STATES PATENT AND TRADEMARK OFFICE

CERTIFICATE OF CORRECTION

PATENT NO. : 5,090,384

DATED : February 25, 1992

INVENTOR(S) : Frank Ahlborn, Volker Schäfer and Albrecht Sieber

It is certified that error appears in the above-identified patent and that said Letters Patent is hereby corrected as shown below:

In column 4, line 30: delete "derivation (n)" and substitute -- derivative (ṅ) -- therefor.

In column 4, line 33: delete "(n)" and substitute -- (ṅ) -- therefor.

Signed and Sealed this

Eighth Day of June, 1993

*Attest:*

Michael K. Kirk

MICHAEL K. KIRK

*Attesting Officer*

*Acting Commissioner of Patents and Trademarks*